US007210464B2

(12) United States Patent
Ukai et al.

(10) Patent No.: US 7,210,464 B2
(45) Date of Patent: May 1, 2007

(54) FUEL PUMP CONTROL SYSTEM FOR CYLINDER CUT-OFF INTERNAL COMBUSTION ENGINE

(75) Inventors: Asao Ukai, Wako (JP); Toshitaka Hachiro, Wako (JP); Tomohiro Nishi, Wako (JP); Takahiro Yonekura, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/029,341

(22) Filed: Jan. 6, 2005

(65) Prior Publication Data

US 2005/0150482 A1 Jul. 14, 2005

(30) Foreign Application Priority Data

Jan. 9, 2004 (JP) ..... 2004-004697

(51) Int. Cl.
*F02M 37/04* (2006.01)

(52) U.S. Cl. ..... 123/497; 123/198 F

(58) Field of Classification Search ..... 123/198 F, 123/197, 357, 456, 198 D, 497
See application file for complete search history.

(56) References Cited

U.S. PATENT DOCUMENTS 4,023,358 A * 5/1977 Maurer et al. ..... 60/277
4,064,844 A * 12/1977 Matsumoto et al. ..... 123/481
4,165,610 A * 8/1979 Iizuka et al. ..... 60/284
4,256,074 A * 3/1981 Sugasawa et al. ..... 60/276
5,433,182 A * 7/1995 Augustin et al. ..... 123/456
5,740,783 A 4/1998 Learman et al.
5,930,992 A * 8/1999 Esch et al. ..... 60/274
5,979,394 A * 11/1999 Schmidt ..... 123/198 F
6,640,543 B1 * 11/2003 Seal ..... 60/609

FOREIGN PATENT DOCUMENTS

JP 10-103097 4/1998
JP 11-182371 7/1999

* cited by examiner

*Primary Examiner*—Carl S. Miller
(74) *Attorney, Agent, or Firm*—Arent Fox LLP

(57) ABSTRACT

In a fuel pump control system for an internal combustion engine whose operation is switched between cut-off-cylinder operating mode during which some of the cylinders are non-operative and full-cylinder operating mode during which all of the cylinders are operative and having a fuel injector connected to the fuel supply line and supplied with fuel pressurized by the fuel pump, it is discriminated whether the operation of the engine is in the full-cylinder operating mode or in the cut-off-cylinder operating mode, the operation of the fuel pump is controlled based on the discriminated operating mode of the engine, i.e., is controlled such that the delivery flow rate of the fuel pump when the engine is discriminated to be in the cut-off-cylinder operating mode, is reduced relative to that when the engine is discriminated to be in the full-cylinder operating mode, thereby reducing the power consumption and operating noise of the fuel pump.

8 Claims, 5 Drawing Sheets

FUEL PUMP CONTROL SYSTEM FOR CYLINDER CUT-OFF INTERNAL COMBUSTION ENGINE

BACKGROUND OF THE INVENTION

1. Field of the Invention

This invention relates to a fuel pump control system for cylinder cut-off internal combustion engine.

2. Description of the Related Art

In one prior art method, the fuel pump for supplying pressurized fuel to the fuel injectors of an internal combustion engine is driven under a constant applied voltage (constant delivery flow rate) while recirculating excess fuel beyond the fuel amount (quantity) required by the engine to the fuel tank through a regulator installed in a pipe inside the fuel tank. The implementation of the excess fuel recirculation system in the fuel tank in this manner simplifies the piping structure and also helps to prevent temperature increase of the fuel in the fuel tank.

When a fuel pump is driven at a constant applied voltage in the foregoing manner, the applied voltage has to be set at a high value (the delivery flow rate has to be made large) so that the supply of fuel does not become deficient even when the fuel amount required by the engine is maximum. When the required fuel amount is small, therefore, much of the fuel pressurized by the fuel pump comes to be recirculated to the fuel tank as excess fuel. This lowers efficiency. Specifically, when the fuel amount required by the engine is small, the fuel pump is supplied with an amount of electric power greater than that needed to supply the required fuel amount, so that the fuel pump consumes a larger than necessary amount of power. Moreover, the operating noise of the fuel pump is maintained at a higher level than necessary.

This led to the idea taught by Japanese Laid-Open Patent Application No. Hei 11(1999)-182371 of calculating a value proportional to the fuel consumption based on the engine speed and then switching the delivery flow rate of the fuel pump between two levels (high flow rate and low flow rate) based on the calculated value.

However, it has also been proposed to improve fuel consumption by switching engine operation, based on the engine load, between full-cylinder operation during which all of the cylinders are supplied with fuel to be operative and cut-off-cylinder operation during which the fuel supply to some of the cylinders are cut-off or stopped to be non-operative, as disclosed in Japanese Laid-Open Patent Application No. Hei 10(1998)-103097.

SUMMARY OF THE INVENTION

However, in an cylinder cut-off internal combustion engine that enables switching of the cylinder operating state between full-cylinder operation and cut-off-cylinder operation, the required fuel amount during full-cylinder operation and that during cut-off-cylinder operation differs greatly at the same engine speed. However, the prior art has not advanced to the level of taking the difference in required fuel amount between that during full-cylinder operation and that during cut-off-cylinder operation into consideration in controlling the driving of the fuel pump.

It is therefore an object of the present invention to overcome the foregoing problems by providing a fuel pump control system for an cylinder cut-off internal combustion engine that controls the driving of a fuel pump with consideration to the difference in required fuel amount between that during full-cylinder operating mode and that during cut-off-cylinder operating mode, thereby reducing the power consumption and operating noise of the fuel pump.

In order to achieve the object, the present invention is configured to have a system for controlling a fuel pump installed in a fuel supply line connected to a fuel tank of an internal combustion engine having a plurality of cylinders and mounted on a vehicle, operation of the engine being switchable between cut-off-cylinder operating mode during which some of the cylinders are non-operative and full-cylinder operating mode during which all of the cylinders are operative, comprising: a fuel injector connected to the fuel supply line and supplied with fuel pressurized by the fuel pump; an engine operating mode discriminator discriminating whether the operation of the engine is in the full-cylinder operating mode or in the cut-off-cylinder operating mode; and a fuel pump controller controlling operation of the fuel pump based on the discriminated operating mode of the engine.

BRIEF DESCRIPTION OF THE DRAWINGS

The above and other objects and advantages of the invention will be more apparent from the following description and drawings, in which.

DETAILED DESCRIPTION OF THE PREFERRED EMBODIMENTS

Preferred embodiments of a fuel pump control system for cylinder cut-off internal combustion engine according to the invention will hereinafter be explained with reference to the drawings.

Figure 1:
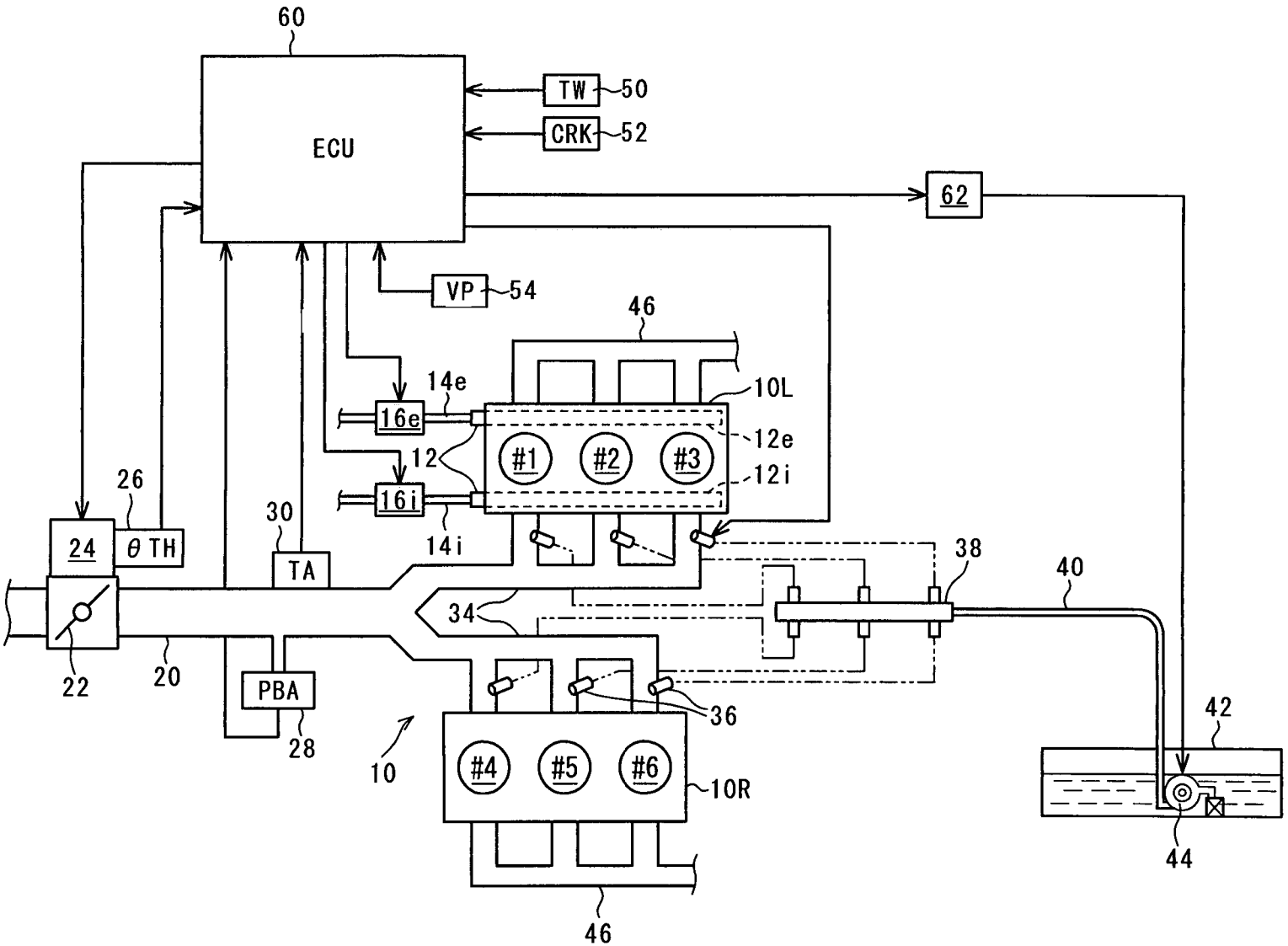
FIG. 1 is a schematic view showing the overall structure of a fuel pump control system for cylinder cut-off internal combustion engine.

FIG. 1 is a schematic view showing the overall structure of a fuel pump control system for cylinder cut-off internal combustion engine according to a first embodiment of this invention.

Reference numeral 10 in FIG. 1 designates a multicylinder engine equipped with a plurality of cylinders (hereinafter sometimes referred to simply as "engine"), which is installed in a vehicle (not shown). The engine 10 is a four-cylinder V-6 SOHC engine having a left bank 10L comprising three cylinders designated #1, #2 and #3 and a right bank 10R comprising three cylinders designated #4, #5 and #6. The left bank 10L of the engine 10 is equipped with a cylinder cut-off mechanism 12.

The cylinder cut-off mechanism 12 comprises an intake-side deactivation mechanism 12*i* for deactivating (closing)

intake valves (not shown) of the cylinders #1 to #3 and an exhaust-side cut-off mechanism 12*e* for deactivating (closing) exhaust valves (not shown) of the cylinders #1 to #3. The intake-side cut-off mechanism 12*i* and exhaust-side cut-off mechanism 12*e* are connected to a hydraulic pump (not shown) through oil lines 14*i* and 14*e*, respectively. Linear solenoids 16*i* and 16*e* are installed in the oil lines 14*i* and 14*e*, respectively, for shutting off supply of hydraulic pressure to the intake-side cut-off mechanism 12*i* and exhaust-side cut-off mechanism 12*e*.

When the linear solenoid 16*i* is deenergized to open the oil line 14*i* and supply the intake-side cut-off mechanism 12*i* with hydraulic pressure, the intake valves and intake cams (not shown) of the cylinders #1 to #3 of the left bank 10L are put out of contact with each other to put the intake valves in the non-operative state (closed state). When the linear solenoid 16*e* is deenergized to open the oil line 14*e* and supply the exhaust-side cut-off mechanism 12*e* with hydraulic pressure, the exhaust valves and exhaust cams (not shown) of the cylinders #1 to #3 of the left bank 10L are put out of contact with each other to put the exhaust valves in the non-operative state (closed state). This establishes cut-off-cylinder operation in which the operation of the cylinders #1 to #3 is cut off or non-operative and only the cylinders #4 to #6 of the right bank 10R operate.

On the other hand, when the linear solenoid 16*i* is energized to close the oil line 14*i*, the supply of operating oil to the intake-side cut-off mechanism 12*i* is shut off to establish contact between the intake valves and intake cams of the cylinders #1 to #3, so that the intake valves are put in the operating state (are driven to open and close).

When the linear solenoid 16*e* is energized to close the oil line 14*e*, the supply of operating oil to the exhaust-side cut-off mechanism 12*e* is shut off to establish contact between the exhaust valves and exhaust cams (not shown) of the cylinders #1 to #3 of the left bank 10L, so that the exhaust valves are put in the operating state (are driven to open and close). As a result, the cylinders #1 to #3 are operated to establish full-cylinder operation of the engine 10. The engine 10 is thus constituted as a cylinder cut-off engine (internal combustion engine) whose operation can be switched between full-cylinder operation and cut-off-cylinder operation.

A throttle valve 22 installed in an intake pipe 20 of the engine 10 regulates the flow rate of intake air. No mechanical connection is established between the throttle valve 22 and an accelerator pedal and, for instance, the throttle valve 22 is connected to an actuator such as an electric motor 24 to be opened and closed thereby. A throttle position sensor 26 installed near the electric motor 24 outputs a signal proportional to the position or opening θTH of the throttle valve 22 (hereinafter referred to as "throttle opening θTH) by detecting the amount of rotation of the electric motor 24.

A manifold absolute pressure sensor 28 and an intake air temperature sensor 30 installed downstream of the throttle valve 22 output signals indicating the manifold absolute pressure PBA (engine load) and the intake air temperature TA.

Fuel injectors 36 are installed near intake ports of the cylinders #1 to #6 at locations immediately downstream of an intake manifold 34 downstream of the throttle valve 22. The fuel injectors 36 are connected through a delivery pipe 38 and a fuel supply pipe 40 to a fuel tank 42.

A fuel pump 44 is installed at the upstream end of the fuel supply pipe 40. The fuel pump 44 is an electrically powered pump driven by an electric motor (not shown) to draw in intake fuel (gasoline fuel) stored in the fuel tank 42, pressurize the drawn-in fuel and deliver it to the fuel injectors 36. A regulator (not illustrated) is installed in the section of the fuel supply pipe 40 located inside the fuel tank 42. When the pressure of the fuel supplied to the fuel injectors 36 rises to or above a prescribed value, the regulator operates to recirculate excess fuel to the fuel tank 42.

The fuel injectors 36 supplied with fuel in the foregoing manner open at fuel injection timing determined in accordance with the operating condition and the like of the engine 10 to inject fuel into the intake ports of the individual cylinders, thereby producing an air-fuel mixture.

The engine 10 is connected to an exhaust pipe (not shown) through an exhaust manifold 46. Exhaust gas produced by combustion of the air-fuel mixture is progressively purified by a catalytic converter (not shown) installed in the exhaust pipe and discharged to the exterior.

A coolant sensor 50 attached to a coolant passage (not shown) of the cylinder block of the engine 10 outputs a signal proportional to the engine coolant temperature TW. A crank angle sensor 52 attached to the crank shaft (not shown) of the engine 10 outputs a CRK signal once every prescribed crank angle (e.g., 30 degrees). A vehicle speed sensor 54 installed near the vehicle drive shaft (not shown) outputs a signal once every prescribed angle of rotation of the drive shaft.

The outputs of the different sensors are sent to an ECU (Electronic Control Unit) 60.

The ECU 60 has a microcomputer that comprises a CPU for performing computations, a ROM for storing computation programs and various data (tables and the like), a RAM for temporarily storing the results of the computations by the CPU, an input circuit, an output circuit and a counter (none of which are shown).

The ECU 60 counts the CRK signals output by the crank angle sensor 52 to determine the engine speed NE and counts the signals output by the vehicle speed sensor 54 to determine a vehicle speed VP indicating the vehicle traveling speed.

The ECU 60 performs the computations based on the input values to determine the fuel injection amount (quantity) and drive the fuel injectors 36 and to determine the ignition timing and control ignition by igniters (not shown). In addition, the ECU 60 determines the amount of rotation (control input) of the electric motor 24 based on the input values to control the throttle opening θTH to the desired value and determines whether or not to energize the linear solenoids 16*i* and 16*e* to switch the operation of the engine 10 between full-cylinder operation and cut-off-cylinder operation.

Further, the ECU 60 uses the input values to determine the voltage to be applied to the fuel pump 44 and outputs a duty signal proportional to the determined voltage to a fuel pump control unit 62. The fuel pump control unit 62 is supplied with a voltage (12 V) from a battery (not shown), converts the battery voltage to a voltage proportional to the duty signal and applies the converted voltage to the fuel pump 44. Driving (more exactly the delivery flow rate) of the fuel pump 44 is thus controlled by applying it with a voltage converted by the ECU 60 and the fuel pump control unit 62.

Next, the operations of the control unit of the fuel pump for cylinder cut-off internal combustion engine according to this embodiment will explained with reference to FIG. 2.

Figure 2:
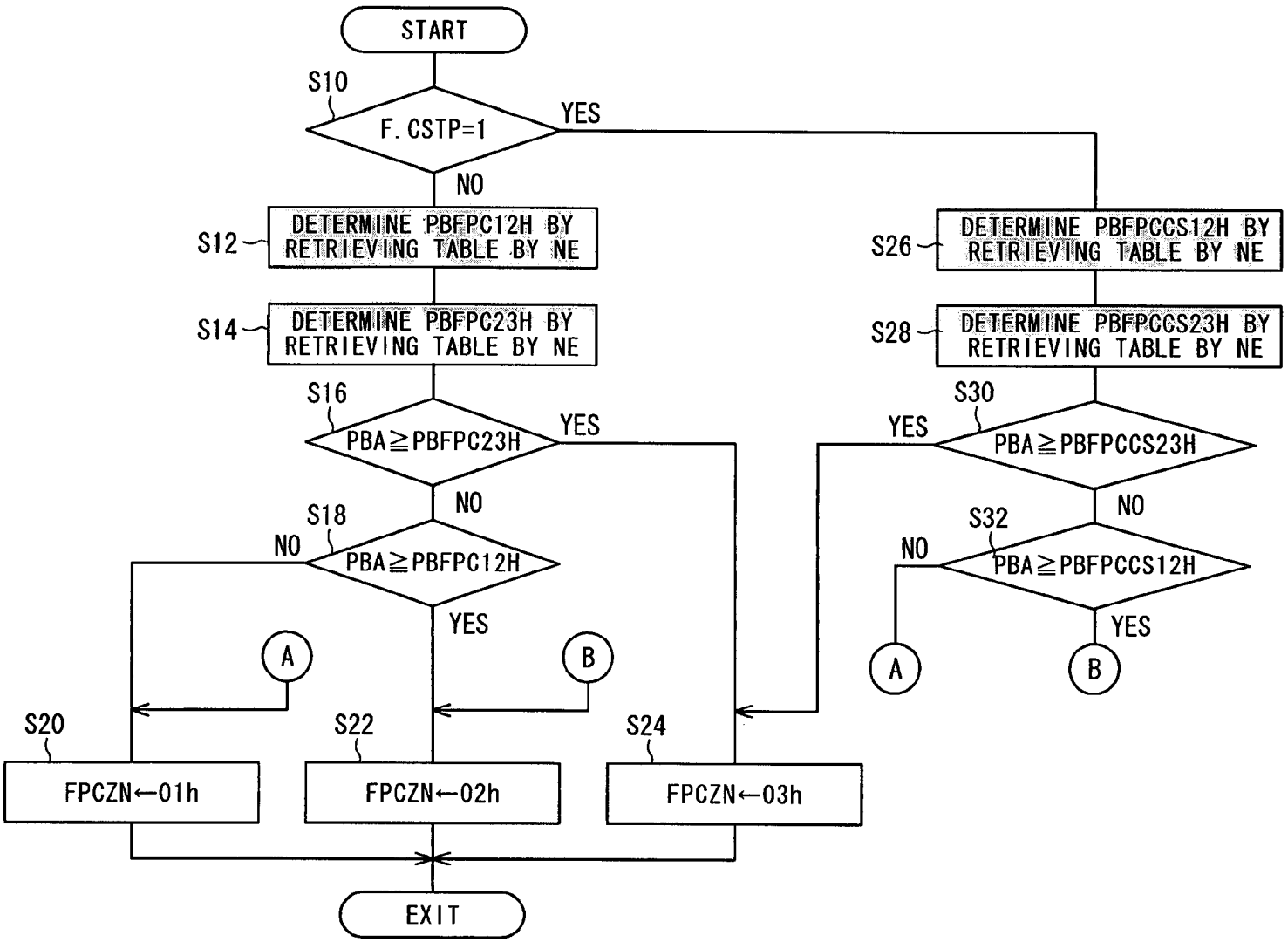
FIG. 2 is a flowchart showing the operations of the system illustrated in FIG. 1 according to a first embodiment of this invention.

FIG. 2 is a flowchart showing the operations of the system illustrated in FIG. 1. The illustrated program is repeatedly executed by the ECU 60 once every prescribed crank angle or time period.

First, in S10, it is checked whether the bit of a flag F.CSTP is set to 1. The bit of the flag F.CSTP is set in a routine not shown in the drawings. The bit being set to 0, the initial value, indicates that full-cylinder operation is in effect, while its being set to 1 indicates that cut-off-cylinder operation is in effect. In other words, the check in S10 amounts to discriminating which of the full-cylinder operating mode and the cut-off-cylinder operating mode of the engine 10 is in effect. Whether or not the engine 10 should be switched to cut-off-cylinder operation is determined in a separate routine (not shown) which uses the vehicle speed VP, engine coolant temperature TW, intake air temperature TA, gear position of the vehicle transmission and other parameters to determine whether adequate torque for maintaining the current driving condition can be obtained even if the cylinders #1 to #3 of the left bank 10L are non-operative or deactivated.

Figure 3:
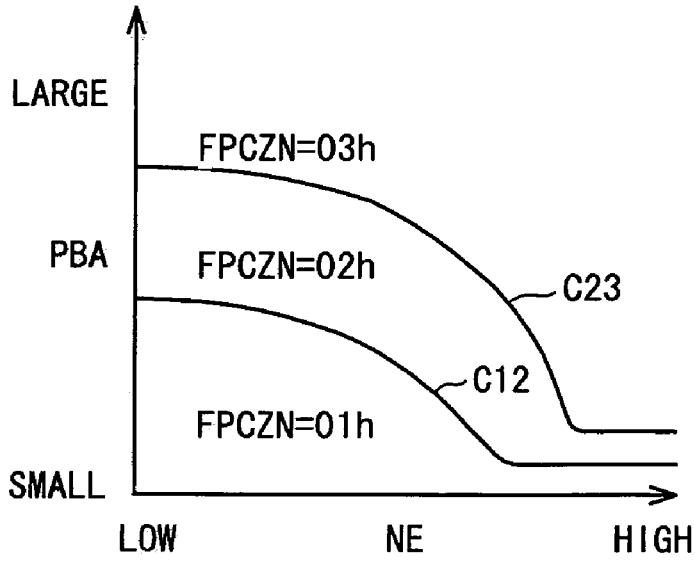
FIG. 3 is a graph showing the characteristic of a table referred to in the flowchart of FIG. 2.

When the result in S10 is NO because full-cylinder operation is found to be in effect, the program goes to S12, in which a first threshold value PBFPC12H is set or determined based on the engine speed NE. The first threshold value PBFPC12H is a threshold value used to determine whether the engine load during full-cylinder operation is low load or is medium or higher load. It is set by retrieving a value from the full-cylinder operation table (whose characteristic is shown in FIG. 3) using the detected value of the engine speed NE as address data. Specifically, the manifold absolute pressure PBA corresponding to the intersection between the first curve C12 and the detected engine speed NE in the full-cylinder operation table is set as the first threshold value PBFPC12H.

Next, in S14, a second threshold value PBFPC23H is set or determined based on the engine speed NE. The second threshold value PBFPC23H is a threshold value used to determine whether the engine load during full-cylinder operation is high load or is medium or lower load. Like the first threshold value PBFPC12H, it is set by retrieving a value from the full-cylinder operation table shown in FIG. 3 using the detected value of the engine speed NE as address data. Specifically, the manifold absolute pressure PBA corresponding to the intersection between the second curve C23 and the detected engine speed NE in the full-cylinder operation table is set as the second threshold value PBFPC23H. As shown, the second curve C23 is defined so that the value of the manifold absolute pressure PBA thereof is greater than that of the first curve C12 for the same engine speed.

Next, in S16, it is checked whether the detected value of the manifold absolute pressure PBA is equal to or greater than the second threshold value PBFPC23H set in the foregoing manner. When the result in S16 is NO, a check is made in S18 so as to determine whether the detected value of the manifold absolute pressure PBA is equal to or greater than the first threshold value PBFPC12H. When the result in S18 is NO, i.e., when the manifold absolute pressure PBA is found to be a low load value below the first threshold value PBFPC12H, the program goes to S20, in which the value 01h is set in load status FPCZN. The value 01h indicates low load and the fuel pump 44 is driven at a first applied voltage (e.g., 9 V). Specifically, the ECU 60 outputs a duty signal to the fuel pump control unit 62 to make it apply a voltage of 9 V to the fuel pump 44.

On the other hand, when the result in S18 is YES, meaning that the manifold absolute pressure PBA is found to be between the first threshold value PBFPC12H and second threshold value PBFPC23H, the program goes to S22, in which the value 02h is set in the load status FPCZN. The value 02h indicates medium load and the fuel pump 44 is driven at a second applied voltage higher than the first applied voltage (e.g., 10 V).

When the result in S16 is YES, meaning that the manifold absolute pressure PBA is found to be a high load value equal to or higher than the second threshold value PBFPC23H, the program goes to S24, in which the value 03h is set in the load status FPCZN. The value 03h indicates high load and the fuel pump 44 is driven at a third applied voltage higher than the second applied voltage (e.g., 12 V (battery voltage)).

Figure 4:
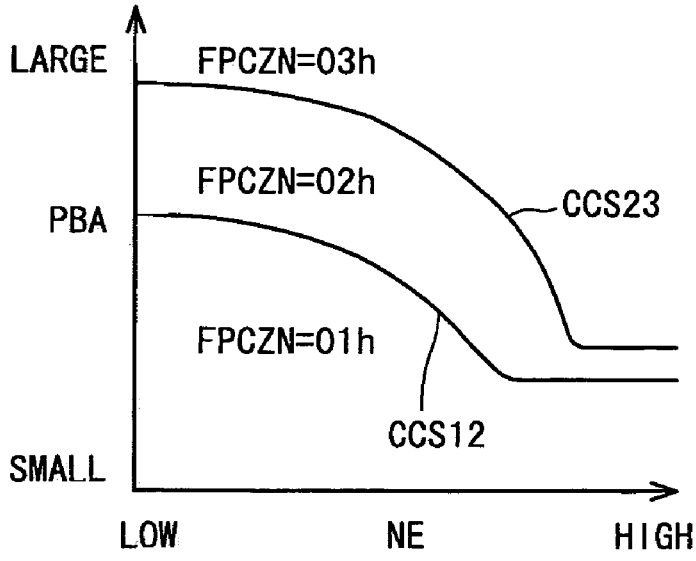
FIG. 4 is a graph also showing the characteristic of a table referred to in the flowchart of FIG. 2.

On the other hand, when the result in S10 is YES because cut-off-cylinder operation is found to be in effect, the program goes to S26, in which a third threshold value PBFPCCS12H is set or determined based on the engine speed NE. The third threshold value PBFPCCS12H is a threshold value used to determine whether the engine load during cut-off-cylinder operation is low load or is medium or higher load. It is set by retrieving a value from the cut-off-cylinder operation table (whose characteristic is shown in FIG. 4) using the detected value of the engine speed NE as address data. Specifically, the manifold absolute pressure PBA corresponding to the intersection between the third curve CCS12 and the detected engine speed NE in the cut-off-cylinder operation table is set as the third threshold value PBFPCCS12H.

Next, in S28, a fourth threshold value PBFPCCS23H is set or determined based on the engine speed NE. The fourth threshold value PBFPCCS23H is a threshold value used to determine whether the engine load during cut-off-cylinder operation is high load or is medium or lower load. Like the third threshold value PBFPCCS12H, it is set by retrieving a value from the cut-off-cylinder operation table shown in FIG. 4 using the detected value of the engine speed NE as address data. Specifically, the manifold absolute pressure PBA corresponding to the intersection between the fourth curve CCS23 and the detected engine speed NE in the cut-off-cylinder operation table is set as the fourth threshold value PBFPCCS23H.

As shown, the fourth curve CCS23 is defined so that the value of the manifold absolute pressure PBA thereof is greater than that of the third curve CCS12 for the same engine speed. In addition, the third curve CCS12 and the fourth curve CCS23 are defined so that the values of the manifold absolute pressure PBA thereof are greater than those of the first curve C12 and second curve C23 for the same engine speed. The reason for this will be explained later.

Next, in S30, it is checked whether the detected value of the manifold absolute pressure PBA is equal to or greater than the fourth threshold value PBFPCCS23H. When the result in S30 is NO, the program goes to S32, in which it is checked whether the detected value of the manifold absolute pressure PBA is equal to or greater than the third threshold value PBFPCCS12H. When the result in S32 is NO, meaning that the load is found to be low, the program goes to S20, in which the value 01h is set in the load status FPCZN. The value 01h indicates low load and the fuel pump 44 is driven at the first applied voltage (9 V).

On the other hand, when the result in S32 is YES, meaning that the load is found to be medium, the program goes to S22, in which the value 02h is set in the load status FPCZN. The value 02h indicates medium load and the fuel pump 44 is driven at the second applied voltage (10 V). When the result in S30 is YES, meaning that the load is found to be high, the program goes to S24, in which the value 03h is set in the load status FPCZN. The value 03h indicates high load and the fuel pump 44 is driven at the third applied voltage (12 V).

Thus in this embodiment, irrespective of whether the operation of the engine 10 is in the full-cylinder operating mode or the cut-off-cylinder operating mode, the level of the engine load is determined (as to whether low load, medium load or high load) by comparing the manifold absolute pressure PBA, which is an index of the engine load (operating condition of the engine 10), and the fuel pump 44 is driven based on the result of the determination at the first applied voltage (9 V), second applied voltage (10 V) higher than the first applied voltage or the third applied voltage (12 V) higher than the second applied voltage. In other words, the voltage to be applied to the fuel pump 44 is lowered (speed of the electric motor for driving the fuel pump 44 is lowered) as the load is lower and the required fuel amount is less (the fuel injection amount of the fuel injectors 36 is smaller), thereby reducing the delivery flow rate of the fuel pump 44. The power consumption and operating noise of the fuel pump 44 can therefore be reduced.

Moreover, since the voltage to be applied can be lowered at starting of the fuel pump 44 (starting of the engine 10), at which time the required fuel amount is less than at high load, the counter electromotive force produced in the electric motor for driving the fuel pump 44 can be reduced, whereby damage to the electric motor (wear of the brushes) can be minimized.

Furthermore, as pointed out earlier, the third curve CCS12 is defined so that the value of the manifold absolute pressure PBA thereof is greater than that of the first curve C12 for the same engine speed, from which it follows that the value of the third threshold value PBFPCCS12H used to determine load during cut-off-cylinder operation is greater than that of the first threshold value PBFPC12H used to determine load during full-cylinder operation. Similarly, the fourth curve CCS23 is defined so that the value of the manifold absolute pressure PBA thereof is greater than that of the second curve C23 for the same engine speed, from which it follows that the value of the fourth threshold value PBFPCCS23H used to determine load during cut-off-cylinder operation is greater than that of the second threshold value PBFPC23H used to determine load during full-cylinder operation.

In other words, the threshold values used to determine load during cut-off-cylinder operation are set larger than the threshold values used to determine load during full-cylinder operation. The voltage to be applied to the fuel pump 44 during cut-off-cylinder operation is therefore not liable to be changed to a large value, so that the delivery flow rate of the fuel pump 44 during cut-off-cylinder operation is made lower than the delivery flow rate during full-cylinder operation. This is because for any given engine speed the required fuel amount is smaller during cut-off-cylinder operation than during full-cylinder operation.

Thus, the manifold absolute pressure PBA indicative of engine load is compared with threshold values to determine the load level, the voltage to be applied to the fuel pump 44 is changed to a larger value with increasing load, a check is made as to whether the engine 10 is in the full-cylinder operating mode or the cut-off-cylinder operating mode, and the threshold values are set to larger values when the engine 10 is found to be in the cut-off-cylinder operating mode than when it is found to be in the full-cylinder operating mode, thereby maintaining the applied voltage during cut-off-cylinder operation, when the required fuel amount is small, so as to be lower than that during full-cylinder operation. The power consumption and operating noise of the fuel pump 44 can therefore be reduced.

As explained in the foregoing, in the fuel pump control system for cylinder cut-off internal combustion engine according to the first embodiment, whether the engine 10 is in full-cylinder operating mode or cut-off-cylinder operating mode is discriminated and driving of the fuel pump 44 is controlled based on the result of the discrimination (the voltage to be applied to the fuel pump 44 is varied). This configuration enables the delivery flow rate of the fuel pump 44 to be varied (the voltage to be applied to the fuel pump 44 to be varied) between the full-cylinder operating mode and the cut-off-cylinder operating mode in accordance with the different required fuel amount between the two modes. As a result, the power consumption and operating noise of the fuel pump 44 can therefore be reduced.

Specifically, taking into account the fact that the required fuel amount at any given engine speed is smaller during cut-off-cylinder operation than during full-cylinder operation, the delivery flow rate (applied voltage) of the fuel pump 44 when the engine 10 is discriminated to be in the cut-off-cylinder operating mode is reduced relative to that when it is discriminated to be in the full-cylinder operating mode. As pointed out above, this configuration enables reduction of the power consumption and operating noise of the fuel pump 44.

Further, the operating condition of the engine 10 (specifically, the manifold absolute pressure PBA indicative of engine load) is detected, the detected value is compared with threshold values and the delivery flow rate of the fuel pump 44 is increased or decreased based on the result of the comparison, while the threshold values are differentiated between the case of operation in the cut-off-cylinder operating mode and the case of operation in the full-cylinder operating mode (specifically, the threshold values are defined differently for one and the same engine speed between the two operating modes). Since it is therefore possible to vary the delivery flow rate of the fuel pump 44 (vary the voltage to be applied to the fuel pump 44) in response to the operating condition of the engine 10, the power consumption and operating noise of the fuel pump 44 can therefore be reduced still further.

A fuel pump control system for cylinder cut-off internal combustion engine according to a second embodiment of the invention will now be explained.

The second embodiment differs from the first embodiment in the point that a dead zone is established in which the load status FPCZN is not changed (the voltage to be applied to the fuel pump 44 is not changed).

Figure 5:
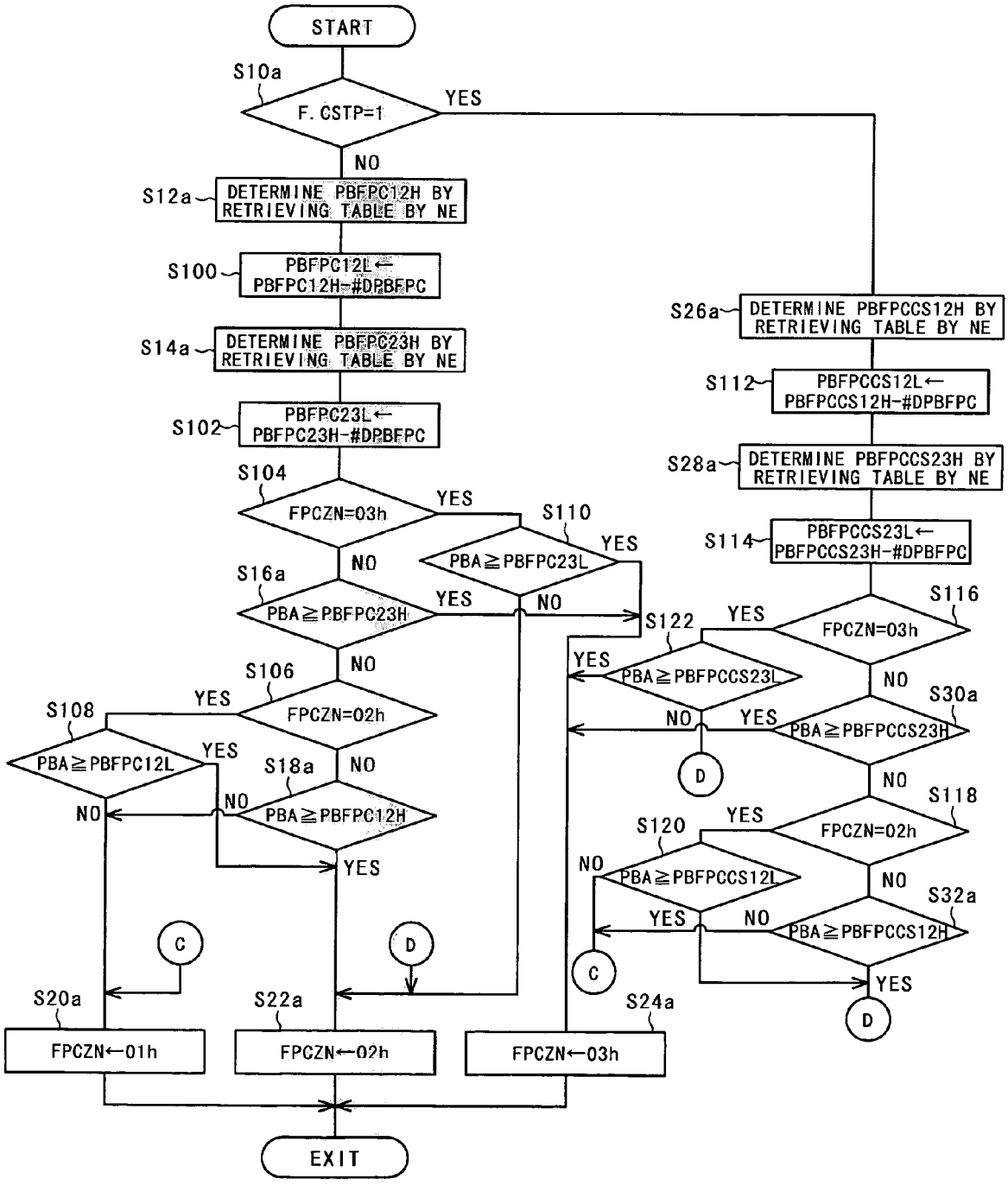
FIG. 5 is a flowchart showing the operations of a fuel pump control system for cylinder cut-off internal combustion engine according to a second embodiment of the invention.

FIG. 5 is a flowchart showing the operations of the fuel pump control system for cylinder cut-off internal combustion engine according to the second embodiment. In the flowchart of FIG. 5, steps similar those in the flowchart of FIG. 2 explained with reference to the first embodiment are assigned like reference symbols suffixed with an "a".

First, in S10*a*, it is checked whether the bit of the flag F.CSTP is set to 1. When the result in S10*a* is NO because full-cylinder operation is found to be in effect, the program goes to S12*a*, in which the first threshold value PBFPC12H is set or determined based on the engine speed NE.

Next, in S100, the value obtained by subtracting a prescribed value #DPBFPC from the first threshold value PBFPC12H is defined as a first offset value PBFPC12L.

Next, in S14*a*, the second threshold value PBFPC23H is set or determined based on the engine speed NE. Then, in S102, the value obtained by subtracting the prescribed value

#DPBFPC from the second threshold value PBFPC23H is defined as a second offset value PBFPC23L.

Next, in S104, it is checked whether the value 03h is set in the load status FPCZN. When the result in S104 is NO, the program goes to S16*a*, in which it is checked whether the detected value of the manifold absolute pressure PBA is equal to or greater than the second threshold value PBFPC23H.

When the result in S16*a* is YES, the program goes to S24*a*, in which the value 03h is set in the load status FPCZN and the fuel pump 44 is driven at the third applied voltage (12 V), and when the result in S16*a* is NO, the program goes to S106, in which it is checked whether the value 02h is set in the load status FPCZN. When the result in S106 is NO (when the value 01h is set in the load status FPCZN), the program goes to S18*a*, in which it is checked whether the detected value of the manifold absolute pressure PBA is equal to or greater than the first threshold value PBFPC12H.

When the result in S18*a* is NO, the program goes to S20*a*, in which the value 01h is set in the load status FPCZN and the fuel pump 44 is driven at the first applied voltage (9 V). On the other hand, when the result in S18*a* is YES, the program goes to S22*a*, in which the value 02h is set in the load status FPCZN and the fuel pump 44 is driven at the second applied voltage (10 V).

When the result in S106 is YES (when the value 02h is set in the load status FPCZN), the program goes to S108, in which it is checked whether the detected value of the manifold absolute pressure PBA is equal to or greater than the first offset value PBFPC12L. When the result in S108 is YES, the program goes to S22*a*, in which the value 02h is set in the load status FPCZN and the fuel pump 44 is driven at the second applied voltage (10 V), and when the result in S108 is NO, the program goes to S20*a*, in which the value 01h is set in the load status FPCZN and the fuel pump 44 is driven at the first applied voltage (9 V).

When the result in S104 is YES (when the value 03h is set in the load status FPCZN), the program goes to S110, in which it is checked whether the detected value of the manifold absolute pressure PBA is equal to or greater than the second offset value PBFPC23L. When the result in S110 is YES, the program goes to S24*a*, in which the value 03h is set in the load status FPCZN and the fuel pump 44 is driven at the third applied voltage (12 V), and when the result in S110 is NO, the program goes to S22*a*, in which the value 02h is set in the load status FPCZN and the fuel pump 44 is driven at the second applied voltage (10 V).

Thus when the applied voltage during full-cylinder operation is changed to a large value, the first threshold value PBFPC12H and second threshold value PBFPC23H are used as in the first embodiment, but when the applied voltage is changed to a small value, the first offset value PBFPC12L and second offset value PBFPC23L, whose values are smaller than those of the first threshold value PBFPC12H and second threshold value PBFPC23H, are used. This prevents frequent switching of the applied voltage (prevents hunting).

Returning to the explanation of the flowchart of FIG. 5, when the result in S10*a* is YES because the cut-off-cylinder operating mode is found to be in effect, the program goes to S26*a*, in which the third threshold value PBFPCCS12H is set or determined based on the engine speed NE, and then to S112, in which the value obtained by subtracting the prescribed value #DPBFPC from the third threshold value PBFPCCS12H is defined as a third offset value PBFPCCS12L.

Next, in S28*a*, the fourth threshold value PBFPCCS23H is set or determined based on the engine speed NE and then, in S114, the value obtained by subtracting the prescribed value #DPBFPC from the fourth threshold value PBFPCCS23H is defined as a fourth offset value PBFPCCS23L.

Next, in S116, it is checked whether the value 03h is set in the load status FPCZN. When the result in S116 is NO, the program goes to S30*a*, in which it is checked whether the detected value of the manifold absolute pressure PBA is equal to or greater than the fourth threshold value PBFPCCS23H.

When the result in S30*a* is YES, the program goes to S24*a*, in which the value 03h is set in the load status FPCZN and the fuel pump 44 is driven at the third applied voltage (12 V), and when the result in S30*a* is NO, the program goes to S118, in which it is checked whether the value 02h is set in the load status FPCZN. When the result in S118 is NO (when the value 01h is set in the load status FPCZN), the program goes to S32*a*, in which it is checked whether the detected value of the manifold absolute pressure PBA is equal to or greater than the third threshold value. PBFPCCS12H.

When the result in S32*a* is NO, the program goes to S20*a*, in which the value 01h is set in the load status FPCZN and the fuel pump 44 is driven at the first applied voltage (9 V), and when the result in S32*a* is YES, the program goes to S22*a*, in which the value 02h is set in the load status FPCZN and the fuel pump 44 is driven at the second applied voltage (10 V).

When the result in S118 is YES, (when the value 02h is set in the load status FPCZN), the program goes to S120, in which it is checked whether the detected value of the manifold absolute pressure PBA is equal to or greater than the third offset value PBFPCCS12L. When the result in S120 is YES, the program goes to S22*a*, in which the value 02h is set in the load status FPCZN and the fuel pump 44 is driven at the second applied voltage (10 V), and when the result in S120 is NO, the program goes to S20*a*, in which the value 01h is set in load status FPCZN and the fuel pump 44 is driven at the first applied voltage (9 V).

When the result in S116 is YES, (when the value 03h is set in the load status FPCZN), the program goes to S122, in which it is checked whether the detected value of the manifold absolute pressure PBA is equal to or greater than the fourth offset value PBFPCCS23L. When the result in S122 is YES, the program goes to S24*a*, in which the value 03h is set in the load status FPCZN and the fuel pump 44 is driven at the third applied voltage (12 V), and when the result in S122 is NO, the program goes to S22*a*, in which the value 02h is set in the load status FPCZN and the fuel pump 44 is driven at the second applied voltage (10 V).

Thus when the applied voltage during cut-off-cylinder operation is changed to a large value, the third threshold value PBFPCCS12H and fourth threshold value PBFPCCS23H are used as in the first embodiment, but when the applied voltage is changed to a small value, the third offset value PBFPCCS12L and fourth offset value PBFPCCS23L, whose values are smaller than those of the third threshold value PBFPCCS12H and fourth threshold value PBFPCCS23H, are used. This prevents frequent switching of the applied voltage (prevents hunting).

Thus in the fuel pump control system for cylinder cut-off internal combustion engine according to the second embodiment of the invention, the threshold values used to determine the applied voltage (delivery flow rate) are made different between the case of increasing the applied voltage (increasing the delivery flow rate) and the case of reducing the applied voltage (reducing the delivery flow rate), thereby establishing a dead zone in which the load status FPCZN is not changed (the voltage applied to the fuel pump 44 is not changed). Therefore, in addition to realizing the advantages of the first embodiment, it further becomes possible to prevent frequent switching of the applied voltage (prevents hunting).

Other aspects of the configuration are the same as those of the first embodiment and will not be explained again here.

A fuel pump control system for cylinder cut-off internal combustion engine according to a third embodiment of the invention will now be explained.

Figure 6:
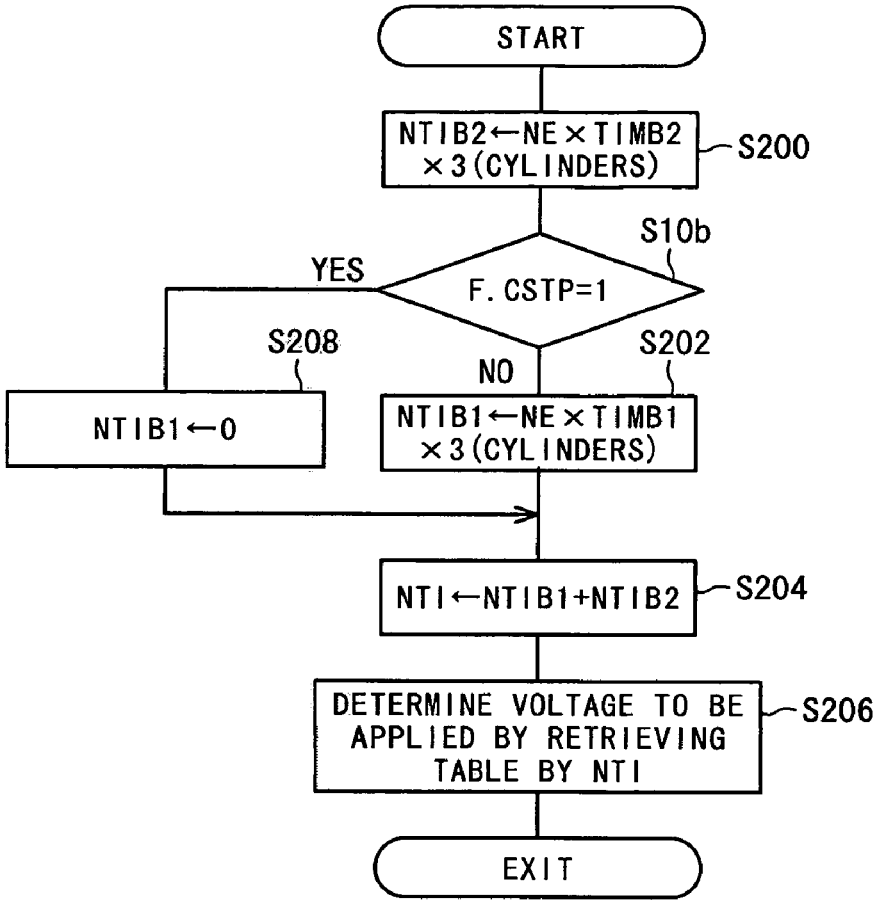
FIG. 6 is a flowchart showing the operations of a fuel pump control system for cylinder cut-off internal combustion engine according to a third embodiment of the invention.

FIG. 6 is a flowchart showing the operations of the fuel pump control system for cylinder cut-off internal combustion engine according to the third embodiment. In the flowchart of FIG. 5, one step similar to that in the flowchart of FIG. 2 explained with reference to the first embodiment is assigned a like reference symbol suffixed with a "b".

First, in S200, the fuel injection time period per unit time period NTIB2 of the right bank 10R is calculated using the following equation:

$$NTIB2 = NE \times TIMB2 \times 3 \quad \text{Eq. 1}$$

In Equation 1, TIMB2 is the base fuel injection time period per cylinder of the cylinders #4 to #6 of the right bank 10R. It is a value retrieved from a prescribed table using the engine speed NE and manifold absolute pressure PBA as address data. As can be seen from Equation 1, the fuel injection time period NTIB2 of the right bank 10R equipped with the three cylinders #4 to #6 is calculated by multiplying the engine speed NE by the base fuel injection time period TIMB2 per cylinder of the right bank 10R and tripling the product (to obtain the period for three cylinders).

Next, in S10*b*, it is checked whether the bit of the flag F.CSTP is set to 1. When the result in S10*b* is NO because the full-cylinder operating mode is found to be in effect, the program goes to S202, in which the fuel injection time period per unit time period NTIB1 of the left bank 10L is calculated using the following equation:

$$NTIB1 = NE \times TIMB\ 1 \times 3 \quad \text{Eq. 2}$$

In Equation 2, TIMB1 is the base fuel injection time period per cylinder of the cylinders #1 to #3 of the left bank 10L. It is a value retrieved from a prescribed table using the engine speed NE and manifold absolute pressure PBA as address data. Thus the fuel injection time period NTIB1 of the left bank 10L equipped with the three cylinders #1 to #3, is calculated by multiplying the engine speed NE by the base fuel injection time period TIMB1 per cylinder of the left bank 10L and tripling the product. Although TIMB2 used in Equation 1 and TIMB1 used in Equation 2 are both retrieved from tables using the engine speed NE and manifold absolute pressure PBA as address data, the tables differ in characteristics so that the values of TIMB2 and TIMB1 are not necessarily the same.

Next, in S204, the fuel injection time period NTIB1 of the left bank 10L calculated in S202 is added to the fuel injection time period NTIB2 of the right bank 10R calculated in S200 to determine the total fuel injection time period of the six fuel injectors 36 installed at the ports of the engine 10. By this there is obtained the fuel injection time period per unit time NTI of the whole engine 10. Calculation of the fuel injection time period amounts to calculation of the fuel injection amount because the fuel injection amount of the fuel injectors 36 per unit time is constant.

Figure 7:
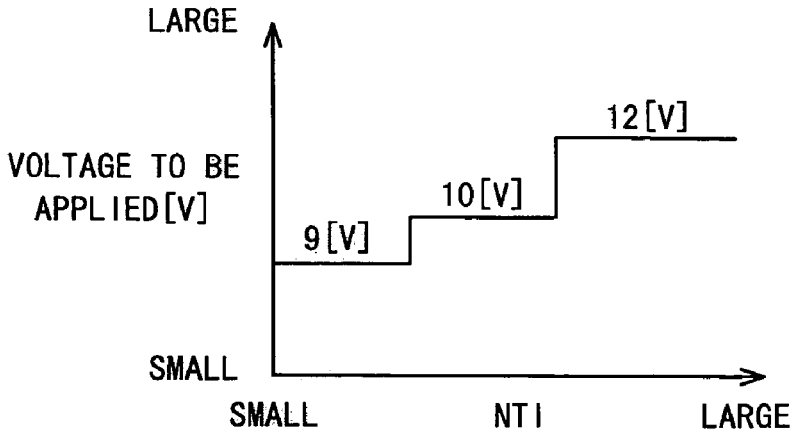
FIG. 7 is a graph showing a table referred to in the flowchart of FIG. 6.

Next, in S206, the voltage to be applied to the fuel pump 44 is determined by retrieval from the table whose characteristic is shown in FIG. 7 using the fuel injection time period NTI calculated in S204 as address data and driving of the fuel pump 44 is controlled in accordance with the so-determined voltage. As shown in FIG. 7, the voltage to be applied to the fuel pump 44 is defined to increase with increasing fuel injection time period NTI (increasing fuel amount required by the engine 10).

On the other hand, when the result in S10*b* is YES because the cut-off-cylinder operating mode is found to be in effect, the program goes to S208, in which the fuel injection time period NTIB1 of the left bank 10L is set at zero.

Therefore, when the engine 10 is being operated in the cut-off-cylinder operating mode, the fuel injection period per unit time period NTIB2 of the right bank 10R calculated in S200 is in S204 defined as the fuel injection time period NTI of the whole engine 10 and the voltage to be applied to the fuel pump 44 is calculated based on this value in S206. In other words, the voltage to be applied to the fuel pump 44 during cut-off-cylinder operation is set to a smaller value than that during full-cylinder operation, so that the delivery flow rate of the fuel pump 44 is reduced.

Thus in the fuel pump control system for cylinder cut-off internal combustion engine according to the third embodiment of the invention, the fuel injection time period NTIB1 for injection of fuel by the fuel injectors installed at the cylinders deactivated during cut-off-cylinder operation (cylinders #1 to #3 of the left bank 10L) and the fuel injection time period NTIB2 for injection of fuel by the fuel injectors installed at the remaining cylinders (cylinders #4 to #6 of the right bank 1OR) are calculated and the voltage to be applied to the fuel pump 44 is determined based on the fuel injection time period NTI, which is the sum thereof. Therefore, as in the first embodiment, the voltage to be applied to the fuel pump 44 can be varied between full-cylinder operation and cut-off-cylinder operation, which are operating modes that differ in required fuel amount, so that the voltage to be applied to the fuel pump 44 during cut-off-cylinder operation is made lower than that during full-cylinder operation. The power consumption and operating noise of the fuel pump 44 can therefore be reduced.

Other aspects of the configuration are the same as those of the first embodiment and will not be explained again here.

The first to third embodiments are thus configured to have a system for controlling a fuel pump 44 (powered by an actuator such as electric motor) installed in a fuel supply line (delivery pipe 38 and fuel supply pipe 40) connected to a fuel tank 42 of an internal combustion engine 10 having a plurality of cylinders (#1 to #6) and mounted on a vehicle, operation of the engine being switchable between cut-off-cylinder operating mode during which some of the cylinders are non-operative and full-cylinder operating mode during which all of the cylinders are operative, comprising: a fuel injector 36 connected to the fuel supply line and supplied with fuel pressurized by the fuel pump 44; an engine operating mode discriminator (ECU 60, S10, S10*a*, S10*b*) discriminating whether the operation of the engine is in the full-cylinder operating mode or in the cut-off-cylinder operating mode; and a fuel pump controller (ECU 60, S12 and on, S12*a* and on, S200 and on) controlling operation (of the actuator) of the fuel pump based on the discriminated operating mode of the engine.

Specifically, the fuel pump controller controls the operation of the fuel pump such that a delivery flow rate of the fuel pump 44 (voltage to be applied to the fuel pump 44) when the engine is discriminated to be in the cut-off-cylinder operating mode, is reduced relative to that when the engine is discriminated to be in the full-cylinder operating mode.

The third embodiment is configured such that the fuel pump controller includes: a first fuel injection amount calculator (ECU 60, S202, S208) calculating a first fuel injection amount (NTIB1) for the fuel injector installed at at least one of the cylinders (#1 to #3) that is non-operative in the cut-off-cylinder operating mode; a second fuel injection amount calculator (ECU 60, S200) calculating a second fuel injection amount (NTIB2) for the fuel injector installed at a cylinder (#4 to #6) other than that is non-operative in the cut-off-cylinder operating mode; and controls the operation of the fuel pump based on the first and second fuel injection amounts (S204, S206).

The first and second embodiments are configured such that the fuel pump controller includes: an engine operating index determiner (ECU 60, manifold absolute pressure sensor 28) determining an index that indicates operating condition of the engine; and a comparator (ECU 60, S16, S18, S30, S32, S16*a*, S18*a*, S30*a*, S32*a*) comparing the determined index with threshold values (first threshold value PBFPC12H, second threshold value PBFPC23H, third threshold value PBFPCCS121H, fourth threshold value PBFPCCS23H); and the fuel pump controller controls the operation of the fuel pump such that the delivery flow rate of the fuel pump is increased/reduced based on a result of the comparison (S20, S22, S24, S20*a*, S22*a*, S24*a*), and wherein the threshold values are varied between the cut-off-cylinder operating mode and the full-cylinder operating mode.

The second embodiment is configured such that the threshold values are made different between a case of increasing the delivery flow rate (the first to fourth threshold values) and a case of reducing the delivery flow rate (first offset value PBFPC12L, second offset value PBFPC23L, third offset value PBFPCCS12L, fourth offset value PBFPCCS23L, each of which are smaller the first to fourth threshold values; S16*a*, S18*a*, S30*a*, S32*a*, S108, S110, S120, S122).

In the above, the index indicates load of the engine (manifold absolute pressure PBA).

Japanese Patent Application No. 2004-004697 filed on Jan. 9, 2004, is incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. A system for controlling a fuel pump installed in a fuel supply line connected to a fuel tank of an internal combustion engine having a plurality of cylinders and mounted on a vehicle, operation of the engine being switchable between cut-off-cylinder operating mode during which some of the cylinders are non-operative and full-cylinder operating mode during which all of the cylinders are operative, comprising:

a fuel injector connected to the fuel supply line and supplied with fuel pressurized by the fuel pump;

an engine operating mode discriminator discriminating whether the operation of the engine is in the full-cylinder operating mode or in the cut-off-cylinder operating mode; and a fuel pump controller controlling operation of the fuel pump based on the discriminated operating mode of the engine, wherein the fuel pump controller comprises:

an engine operating index determiner determining an index that indicates operating condition of the engine; and a comparator comparing the determined index with threshold values, and wherein the fuel pump controller controls the operation of the fuel pump such that the delivery flow rate of the fuel pump is increased or reduced based on a result of the comparison.

2. The system according to claim 1, wherein the fuel pump controller controls the operation of the fuel pump such that a delivery flow rate of the fuel pump when the engine is discriminated to be in the cut-off-cylinder operating mode, is reduced relative to that when the engine is discriminated to be in the full-cylinder operating mode.

3. The system according to claim 1, wherein the threshold values are varied between the cut-off-cylinder operating mode and the full-cylinder operating mode.

4. The system according to claim 1, wherein the index indicates load of the engine.

5. A method of controlling a fuel pump installed in a fuel supply line connected to a fuel tank of an internal combustion engine having a plurality of cylinders and mounted on a vehicle and a fuel injector connected to the fuel supply line and supplied with fuel pressurized by the fuel pump, operation of the engine being switchable between cut-off-cylinder operating mode during which some of the cylinders are non-operative and full-cylinder operating mode during which all of the cylinders are operative, comprising the steps of:

discriminating whether the operation of the engine is in the full-cylinder operating mode or in the cut-off-cylinder operating mode; and controlling operation of the fuel pump based on the discriminated operating mode of the engine, wherein the step of controlling operation of the fuel pump further comprises:

determining an index that indicates operating condition of the engine; and comparing the determined index with threshold values, and wherein the fuel pump controller controls the operation of the fuel pump such that the delivery flow rate of the fuel pump is increased or reduced based on a result of the comparison.

6. The method according to claim 5, wherein the step of fuel pump controlling controls the operation of the fuel pump such that a delivery flow rate of the fuel pump when the engine is discriminated to be in the cut-off-cylinder operating mode, is reduced relative to that when the engine is discriminated to be in the full-cylinder operating mode.

7. The method according to claim 5, wherein the threshold values are varied between the cut-off-cylinder operating mode and the full-cylinder operating mode.

8. The method according to claim 5, wherein the index indicates load of the engine.

* * * * *